United States Patent [19]

Inoue et al.

[11] Patent Number: 4,920,730

[45] Date of Patent: May 1, 1990

[54] COIN WRAPPING APPARATUS

[75] Inventors: Mitsuyoshi Inoue, Nara; Shuji Nakanishi; Yoshiaki Uemizo, both of Osaka, all of Japan

[73] Assignee: Nihon Kinsen Kikai Kabushiki Kaisha, Osaka, Japan

[21] Appl. No.: 238,004

[22] Filed: Aug. 29, 1988

[30] Foreign Application Priority Data

| | | | |
|---|---|---|---|
| Aug. 31, 1987 | [JP] | Japan | 62-218929 |
| Aug. 31, 1987 | [JP] | Japan | 62-218930 |
| Sep. 11, 1987 | [JP] | Japan | 62-229312 |

[51] Int. Cl.[5] ..... B65B 11/04; B65B 35/50

[52] U.S. Cl. ..... 53/532; 53/212; 53/215; 453/61

[58] Field of Search ..... 53/532, 211, 212, 215, 53/587, 216; 100/87; 453/62, 61; 414/675

[56] References Cited

U.S. PATENT DOCUMENTS

| | | | |
|---|---|---|---|
| 621,955 | 3/1899 | Anderson | 53/215 X |
| 1,875,567 | 9/1932 | Daniels | 53/212 X |
| 2,092,066 | 9/1937 | Haupt | 53/211 X |
| 3,886,957 | 6/1975 | Ushio | 53/212 X |
| 3,905,176 | 9/1975 | Ushio | 53/212 |
| 3,911,641 | 10/1975 | Miller | 100/87 X |

FOREIGN PATENT DOCUMENTS

| | | | |
|---|---|---|---|
| 2034111 | 1/1972 | Fed. Rep. of Germany | 53/215 |
| 550369 | 10/1956 | Italy | 53/215 |

*Primary Examiner*—John Sipos

*Attorney, Agent, or Firm*—Jordan and Hamburg

[57] ABSTRACT

A coin wrapping apparatus for automatically piling coins in a specified number and wrapping a pile of coins in wrapping comprising a pair of main rollers, a proper number of guide rollers, and a belt passed over these rollers and bent at a portion thereof between the pair of main rollers into a curved shape to form a coin holding means as its main part which constitutes a coin piling unit so as to make it possible to attain coin piling function by a simpler structure. A coin piling and wrapping unit for piling and wrapping coins is constructed using the main part which can perform piling and wrapping in the same section and can be moved into and from the main body of the coin wrapping apparatus.

29 Claims, 21 Drawing Sheets

COIN WRAPPING APPARATUS

BACKGROUND OF THE INVENTION AND RELATED ART STATEMENT

This invention relates to a coin wrapping apparatus in which a specified number of coins are piled and the piled coins are wrapped in wrapping.

A conventional coin wrapping apparatus of this type, such as one disclosed in Japanese Examined Patent Publication No. 55-34048 or one in Japanese Examined Utility Model Publication No. 53-36284, includes a coin supply unit having a coin feeder, a coin counter and other devices necessary for coin supply, a coin piling unit for piling coins fed from the coin supply unit in a specified number, a coin wrapping unit for wrapping the piled coins in wrapping, and a unit for driving and controlling these units, whereby coins are automatically piled and wrapped.

The coin piling unit in the coin wrapping apparatus is so designed as to collect coins in a cylinder or coin arranging cylinder having a diameter corresponding to that of the coin. A coin wrapping appratus disclosed in the Japanese Examined Patent Publication No. 55-34048 which is applicable for a plurality types of coin having different sizes includes a coin arranging cylinder made up of many segments partially overlapping each other, a mechanism for cooperationally actuating the segments in radial directions and a mechanism for driving the actuating mechanism according to coin type setting operation, so that the coin arranging cylinder can be expanded and contracted.

In coin piling units, it is required to prevent coins from standing in a coin arranging cylinder so that they are properly piled in prostrated state in the cylinder. Japanese Examined Patent Publication No. 42-902 discloses a coin piling unit to achieve the above requirement which includes a coin arranging cylinder swingable in vertical and horizontal directions and an operating mechanism for swinging the cylinder according to rotation of a cam driven by a driver.

However, it will be apparent that this structure, in addition to members constituting the coin arranging cylinder, requires a mechanism for supporting the cylinder in such a way that it can be swung and the operating mechanism for swinging the cylinder, consequently making the construction complicated. In addition, if the above-mentioned expandable coin arranging cylinder, which is complicated in construction, is combined with the above-mentioned mechanism to give the cylinder a swing, the entire construction of coin piling unit greatly becomes complicated. Consequently, the problems are involved where constructability and reliability are reduced and construction cost is increased.

Furthermore, a conventional coin wrapping apparatus, separately from a coin piling unit, has a coin wrapping unit in order to fulfill the function of piling a specified number of coins in the proper way and the function of wrapping coins. The coin wrapping unit is provided under the coin piling unit and includes three rotatable rollers. In the coin wrapping unit, a pile of coins conveyed from the coin piling unit is positioned between the rollers. Wrapping is introduced from a wrapping supply unit to a clearance between the rollers and the pile. Simultaneously, the rollers are rotated to wrap the pile in wrapping. However, it will be seen that such separate provision of a coin piling unit and a coin wrapping unit inevitably requires to separately provide their respective components such as a coin arranging cylinder and rollers, and mechanisms for driving and controlling the components, consequently requiring an increased number of components for the unit. Also, since the coin piling unit and the coin wrapping unit are positioned in the vertical direction, the overall height of the coin wrapping apparatus becomes greater. Therefore, such conventional coin wrapping apparatus has disadvantages of having larger size and greater weight.

Moreover, in conventional coin wrapping apparatus, components constituting the coin wrapping unit are provided at specified positions in a main body of a coin wrapping apparatus with being mounted on the fixed frame attached to a main body of the coin wrapping apparatus. Accordingly, when a jam occurs in the wrapping unit due to its improper wrapping process, it is inconvenient to remove jammed wrapping. Also, maintenance is very cumbersome. More specifically, when jam occurs in the wrapping unit, it is required that a door provided in a front panel or side panel of the main body is firstly opened and a hand, a pincette, or other similar tool is inserted through the door and the jammed wrapping is finally removed from a space between the wrapping rollers. Accordingly, smooth removal is difficult and the removing operation is troublesome.

It is therefore an object of the present invention to provide a coin wrapping apparatus which eliminates the abovementioned disadvantages.

Other objects and advantages of the present invention will become apparent from the following description.

SUMMARY OF THE INVENTION

According to the present invention, a coin wrapping apparatus for wrapping a pile of coins in wrapping comprises a coin piling unit for piling coins in a specified number, the coin piling unit comprising a belt having a specified width and passed over a pair of main rollers and a guide roller arranged in parallel at a given interval, coin holding means formed by bending a portion of the belt between the pair of main rollers into a curved shape for piling and holding a specified number of coins fed from a coin supply unit, back-up rollers provided on the back of the portion of the belt in which the coin holding means is formed, and driving means for rotating the pair of main rollers so as to drive the belt when coins are fed in the coin holding means.

With the above-mentioned coin wrapping apparatus, coins are piled in the coin holding means or the curved portion of the belt. When coins are piled, the belt is driven so as to give a torque to coins. Consequently, coins are prevented from standing. Since the belt serves both as coin holding means and as a part of a driving mechanism for rotating the belt so as to prevent coins from standing, coin piling function can be achieved in a relatively simple structure. Furthermore, by constructing one of the guide rollers and the backup rollers so as to adjust their respective positions, the coin holding means formed by the belt can be expanded and constracted by adjusting their positions. Accordingly, the diameter of the coin holding means can be easily adjusted according to the types of coin.

Furthermore, the present invention provides a coin wrapping apparatus comprising a coin piling and wrapping unit for piling and arranging coins fed from a coin supply unit in a specified number and wrapping a pile of coins in wrapping supplied from a wrapping supply unit, the coin piling and wrapping unit comprising a belt having a specified width and passed over a pair of main rollers and a guide roller arranged in parallel at a specified interval, coin holding means formed by bending a portion of the belt between the pair of main rollers into a cylinder having a top opening, a bottom opening, and an side opening for introducing wrapping between the main rollers, backup roller provided on the back of the portion of the belt in which the coin holding means is formed, the side opening being at an ahead position in a moving direction of wrapping from a wrapping supply unit, a movable coin support device, a movable crimping hook, and a driving device for rotating the pair of main rollers so as to drive the belt.

Accordingly, coins are piled and wrapped in the coin holding means formed by the curved portion of the belt. In other words, functions of piling and wrapping are performed in a common unit and a driving means is used for piling and wrapping. This makes a coin piling and wrapping section compact, providing a smaller and lighter coin wrapping apparatus. Also, since piling and wrapping are performed in the same section, an improved wrapping efficiency is obtainable.

Furthermore, the present invention provides a coin wrapping apparatus in which main parts of the above-mentioned coin piling and wrapping unit including the pair of main rollers, guide roller, belt and backup rollers are supported by a support frame, one side of the support frame being axially supported on a main body of the coin wrapping apparatus by a longitudinal rod so that the support frame carrying the main parts of the coin piling and wrapping unit are moved about the longitudinal rod from an inserted state that the support frame is entirelY positioned in the main body of the coin wrapping apparatus to a withdrawn state that the support frame is mostly positioned outside the main body of the coin wrapping apparatus and vice versa, with a releasable stopper provided between the support frame and the main body of the coin wrapping apparatus for maintaining the inserted state.

Accordingly, when a jam occurs in the coin piling and wrapping unit, the piling and wrapping unit are mostly moved outside the main body of the coin wrapping apparatus to remove jammed wrapping. Accordingly, if jam or other troubles take place, necessary operations such as removal of jammed wrapping can be easily performed outside the main body of the coin wrapping apparatus.

DETAILED DESCRIPTION OF PREFERRED EMBODIMENTS OF THE INVENTION

Figure 1:
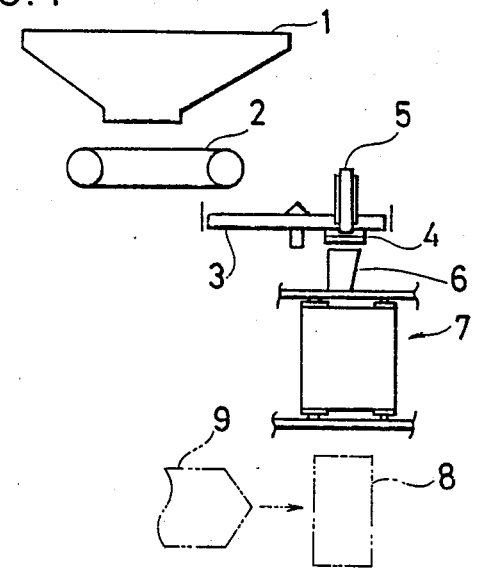
FIG. 1 is a diagrammatic view showing an internal mechanism of a first coin wrapping apparatus of the present invention.

A first embodiment of the present invention will be described with reference to FIGS. 1 through 11. Referring to FIG. 1, a coin wrapping apparatus has a hopper 1 for depositing coins in its top portion. Coins are transferred from the hopper 1 to a rotarY disc 3 by a belt conveyor 2. The rotary disc 3 causes coins to move through a predetermined portion of the periphery thereof to a coin passage 4 by virtue of centrifugal force. Coins are then delivered one by one through the coin passage 4 to a chute 6 by a belt 5 provided at a position opposite to the coin passage 4. When a specified number of coins are counted by coin counting device (not illustrated) provided on the coin passage, the coin delivery is stopped. Coins delivered from the coin passage 4 is supplied through the chute 6 to a coin piling unit 7 which will be described in detail later. The above described construction constitutes a coin supply unit of the coin wrapping apparatus.

Below the coin piling unit 7 is provided a coin wrapping unit 8. The coin wrapping unit 8 is constructed so as to wrap a pile of coins conveyed from the coin piling unit 7 by means of an elevatable coin support in wrapping 9 supplied from a wrapping supply unit. A specific construction is not illustrated. However, it is appropriate to use a conventional wrapping unit in which a pile of coins is wrapped by positioning the pile of coins between three rollers being synchronously rotated, introducing wrapping 9 into a clearance between the rollers, wrapping the pile of coins in the wrapping 9 with the pile being rotated, and crimping top and bottom ends of the wrapping by a crimping hook. A wrapped pile of coins is transferred through a discharge passage not illustrated) to a discharge opening.

Figure 2:
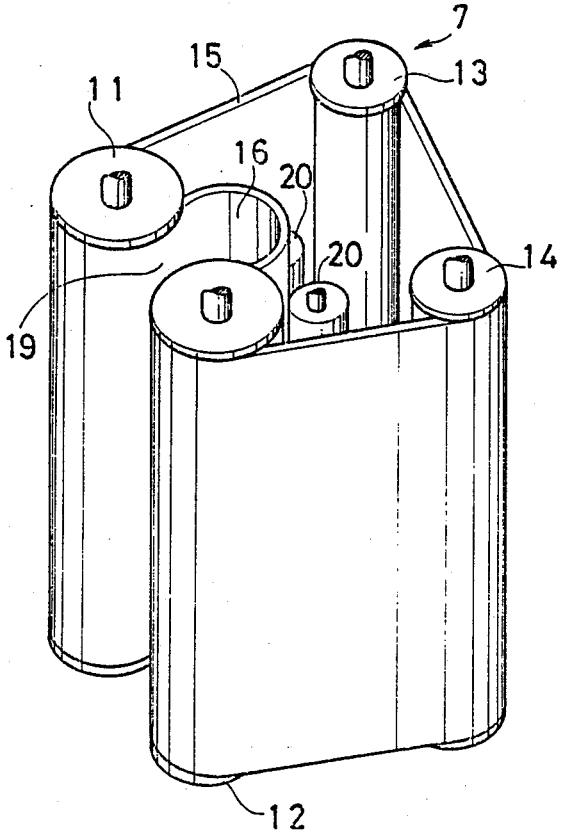
FIG. 2 is a perspective view showing a main construction of a coin piling unit of the coin wrapping apparatus.
Figure 3:
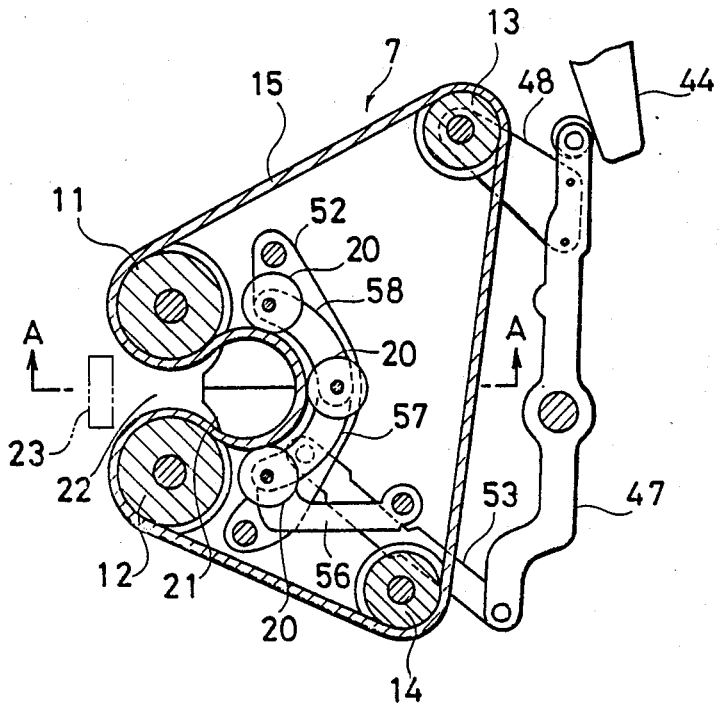
FIG. 3 is a horizontal sectional view of the coin piling unit.
Figure 4:
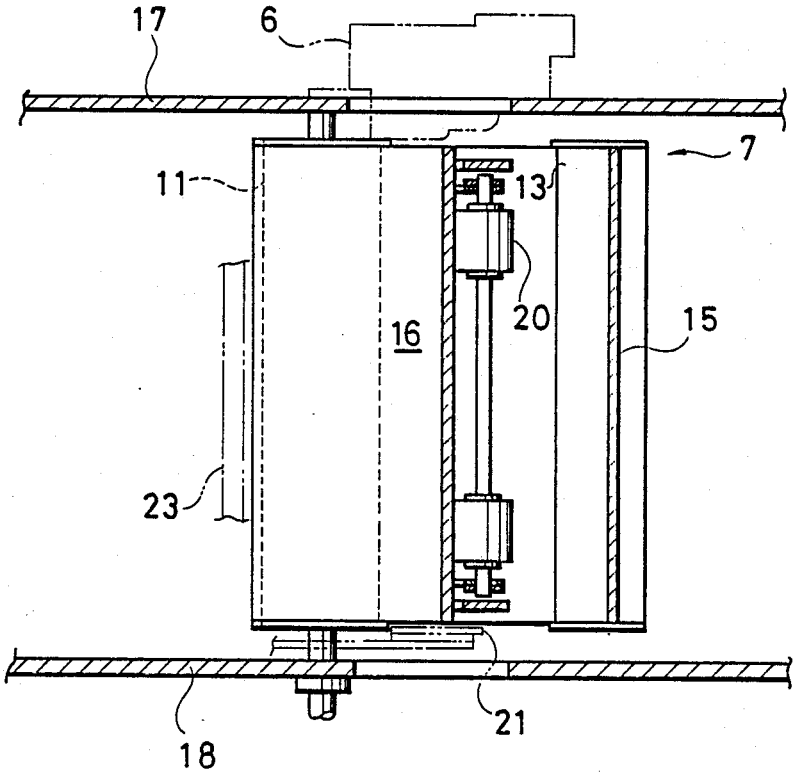
FIG. 4 is a sectional view taken along line A—A of FIG. 3.

A main construction of the coin piling unit 7 will be described with reference to FIGS. 2 through 4. Referring to these figures, the coin piling unit 7 includes a belt 15 having a specified width larger than the height of a pile of coins having a specified number of coins. The belt 15 is passed over a pair of main rollers 11 and 12 and a desirable number of guide rollers. In this embodiment, two guide rollers 13 and 14 are provided. A coin holding means 16 for piling coins is formed by the belt 15.

The rollers 11, 12, 13, 14 are so arranged that their respective axes are vertical and in parallel with one another. The pair of main rollers 11 and 12 are arranged at a distance smaller than the diameter of coin and rotatably mounted on an upper support plate 17 and a lower support plate 18. The rollers 11, 12 are rotated at a predetermined time by a driving means which will be described later. The guide rollers 13 and 14 are rotatably provided at a proper distance from the main rollers 11 and 12. The guide roller 13 is horizontally moved by a position adjusting mechanism which will be also described later.

The belt 15 has such a length as to make it possible to bend inward at a position between the pair of main rollers 11 and 12 to form a curved shape. The belt 15, which is passed over the main rollers 11 and 12 and the guide rollers 13 and 14, provides the coin holding means 16 in the form of substantially cylinder at the curved portion. The belt 15 is continuously moved by the main rollers 11 and 12 while being tensioned at a portion extending from the main roller 11 through the guide rollers 13 and 14 to the main roller 12, and loosened so as to keep the curve portion between the main rollers 11 and 12. The belt 15 is a toothed belt. The circumferential surface of each of the main rollers 11 and 12 has teeth for engaging the teeth on the belt 15.

On the back of the curved portion of the belt 15 where the coin holding means 16 is formed are provided backup rollers 20 in a desirable number, three in this embodiment. The backup rollers 20 are arranged along the curved portion of the belt 15 so that the curved portion is held in the form of a cylinder. The backup rollers are horizontally moved by a position adjusting mechanism which will be described later.

Figure 5:
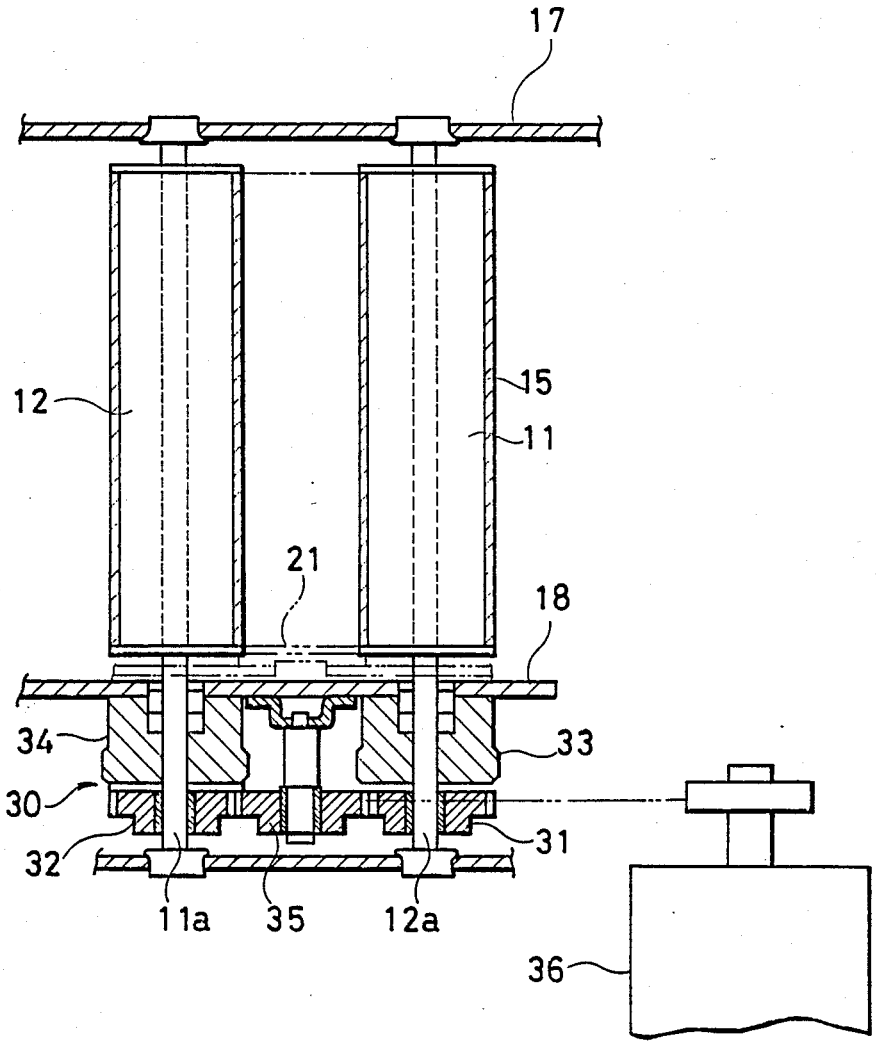
FIG. 5 is a vertical sectional view of the coin piling unit showing a means for driving a belt.

The top opening of the coin holding means 16 corresponds to a bottom opening of the chute 6 of the coin supply unit. In a portion corresponding to the bottom opening of the coin holding means 16 is provided an openable shutter 21 to form a bottom of the coin holding means 16. The coin holding means 16 has a side opening 19 between the main rollers 11 and 12. To prevent coins from escaping through the side opening 19, a center guide 23 is provided in a position corresponding to the side opening 19. FIG. 5 shows a driving device 30 for rotating the main rollers 11 and 12 to drive the belt 15 when coins are piled and wrapped. However, some minor parts are omitted. The driving device 30 comprises gears 31 and 32 mounted on rotating shafts 11*a* and 12*a* of the main rollers 11 and 12 for driving the main rollers 11 and 12, clutches 33 and 34 for engaging the gears 31 and 32 with the rotating shafts 11*a* and 12*a*, a gear 35 meshed with the main roller driving gears 31 and 32, and a transmission mechanism (not illustrated) including a belt, a pulley and an intermediate gear for transmitting rotation of a motor 36 to the gear 35. The main roller driving gears 31 and 32 are synchronously rotated at a specified speed by driving force transmitted from the motor 36. At this time, the clutches 33 and 34 are engaged, so that the rotation of said gears 31 and 32 is transmitted to the main rolers 11 and 12. Consequently, the main rollers 11 and 12 are rotated. The clutches 33 and 34 are controlled by control means (not illustrated) so that the main rollers 11 and 12 are driven when coins are supplied from the coin supply unit to the coin holding means.

Figure 6:
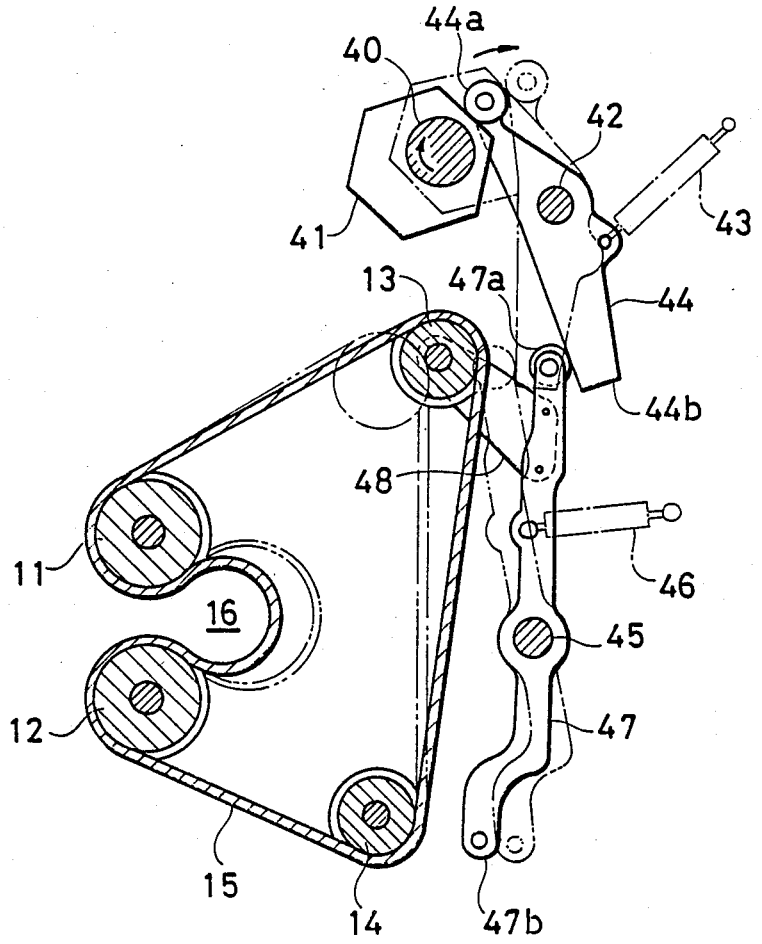
FIG. 6 is a horizontal sectional view of the coin piling unit showing a mechanism for adjusting the position of a guide roller.
Figure 7:
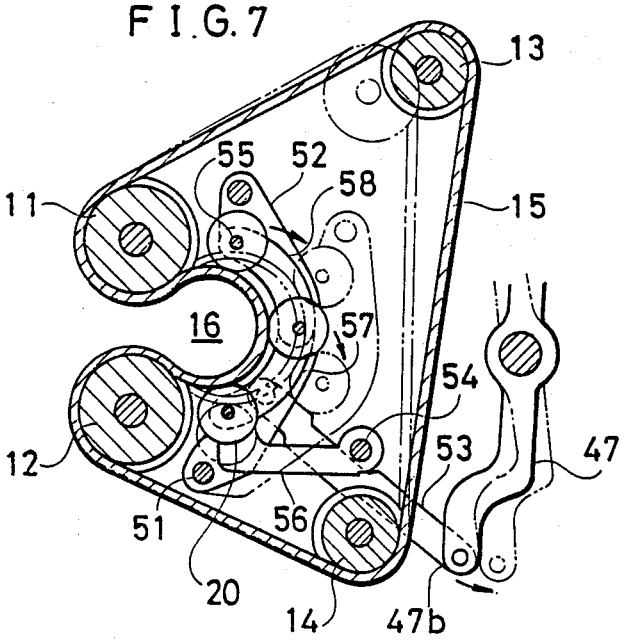
FIG. 7 is a horizontal sectional view of the coin piling unit showing a mechanism for adjusting the position of backup rollers.
Figure 8:
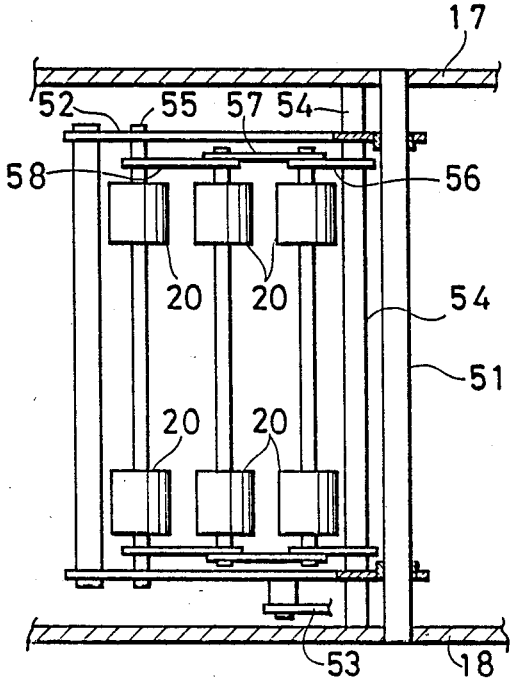
FIG. 8 is a side view of the mechanism for adjusting the position of backup rollers.

FIG. 6 shows a position adjusting mechanism for the guide roller 13. FIGS. 7 and 8 show a position adjusting mechanism for the backup rollers 20. As shown in these figures, the guide roller 13 and the backup rollers 20 are constructed so as to move respectively in accordance with rotation of an operating rod 40 which is connected to a coin type setting dial (not illustrated). The rod 40 is constructed so as to rotate following movement of the dial which is actuated pursuant to the types of coin to be wrapped. Rotation of the operating rod 40 is then transmitted to the guide roller 13 and the backup rollers 20. Consequently, they are moved to expand and contract the coin holding means 16 at the curved portion of the belt. In other words, the diameter of the coin holding means 16 is controlled according to the diameter of coin, which is varied according to the types of coin.

More specifically describing these position adjusting mechanisms, the position adjusting mechanism for the guide roller 13 shown in FIG. 6 comprises a polygonal cam 41 provided on the operating rod 40, lever 44 pivotable about a fulcrum shaft 42 and biased by a spring 43 so that a roll part 44*a*at one end of the lever comes into contact with the cam 41, a movable block 47 pivotable about a fulcrum shaft 45 and biased by a spring 46 so that a roll part 47*a* at one end of the block comes into contact with the other end 44*b* of the lever 44, and a guide roller supporting bracket 48 mounted on the movable block 47. The guide roller 13 is rotatably mounted on the bracket 48. Accordingly, when the cam 41 is rotated by the coin type setting operation, the lever 44 and the movable block 47 are pivoted to move the guide roller 13 along a circular arc whose center is at the fulcrum shaft 45. Consequently, the coin holding means 16 is expanded or contracted to attain a diameter corresponding to the types of coin to be wrapped.

The position adjusting mechanism for the backup rollers 20 shown in FIGS. 7 and 8 comprises a movable frame 52 mounted on upper and lower supporting plates 17 and 18 by a shaft 51 and movable about one end thereof, an arm 53 for connecting the movable frame 52 to the other end 47*b* of the movable block 47, and three sets of links 56, 57, 58 arranged between a shaft 54 mounted on the supporting plates 17 and 18 and a shaft 55 mounted on the movable plate 52. The backup rollers 20 are carried by the links 56, 57, 58. Accordingly, the movable block 47 is pivoted according to the coin type setting operation, so that the backup rollers 20 moves in cooperation with the movement of the guide roller 13. In other words, the links 56, 57, 58 are displaced according to the rotation of the movable frame 52 cooperably connected with the movable block 47. Consequently, the backup rollers 20 are moved in accordance with expansion and contraction of the coin holding means 16 when executing the coin type setting operation.

Figure 9:
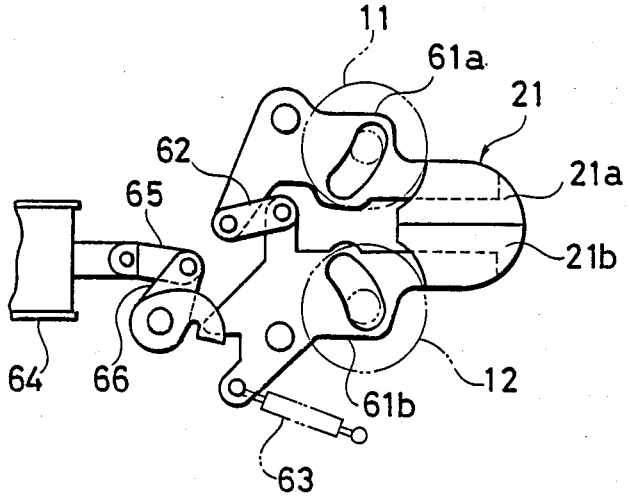
FIG. 9 is a plan view of a shutter provided in the coin piling unit showing its operation.

The shutter 21 forming the bottom of the coin holding means 16, as shown in FIG. 9, includes a pair of shutter plates 21*a* and 21*b* mounted on shutter holding plates 61*a* and 61*b* which are cooperably connected with each other by a link 62. The shutter 21 is biased by a spring 63 so as to close. When necessary, the shutter 21 is opened by a driving solenoid 64, a link 65 and an arm 66.

Operation of the above-described first embodiment of the present invention will then be described.

When a specified number of coins are supplied from the coin supply unit into the coin holding means 16 of the coin piling unit 7 and piled, the clutch 34 of the driving device 30 is firstly engaged to drive the main roller 12 positioned at the rear side in the moving direction of the belt relative to the coin holding means 16. Consequently, the curved portion of the belt between the main rollers 11 and 12 is pressed against the backup rollers 20 to form the coin holding means 16 into the shape of a predetermined cylinder. Thereafter, the clutch 33 is engaged, so that the main rollers 11 and 12 are synchronously rotated at a constant speed. In this case, since the positions of the guide roller 13 and the backup rollers 20 are adjusted in advance by the coin type setting operation, the diameter of the coin holding means 16 is adjusted to such a diameter as to leave a very small space between the inner surface of the coin holding means and coins to be piled.

Figure 10:
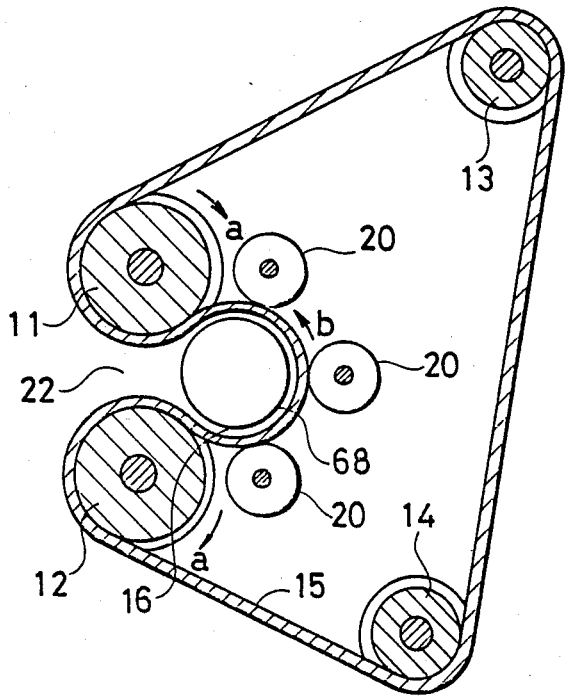
FIGS. 10 and 11 are views explaining operation of the coin piling unit.
Figure 11:
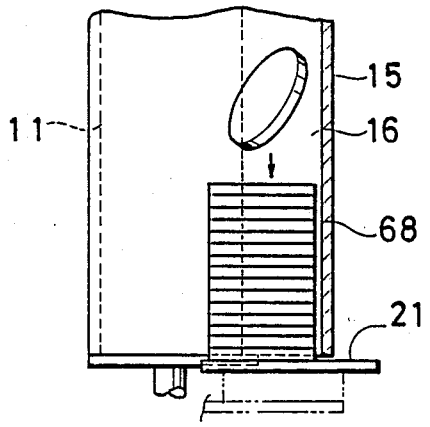

As shown in FIGS. 10 and 11, the belt 15 forming the side wall of the coin holding means 16 is driven to move circumferentially as indicated by an arrow b due to the rotation of the main rollers 11 and 12 as indicated by arrows b. Simultaneously, a specified number of coins 68 are supplied one by one into the coin holding means 16 through the top opening. If a supplied coin 68 stands with leaning against the side wall of the coin holding means 16, the belt 15 gives a torque to the standing coin 68. Consequently, the coin is prostrated. This securely prevents coins from standing. Accordingly, coins 68 are piled in properly prostrated state.

When this coin piling operation is completed, the driving of the main rollers 11 and 12 is stopped and then the shutter 21 is opened. Simultaneously, a pile of coins is transferred by the elevatable support (not illustrated) to the coin wrapping unit 8, where the coin wrapping operation is then performed.

Figure 12:
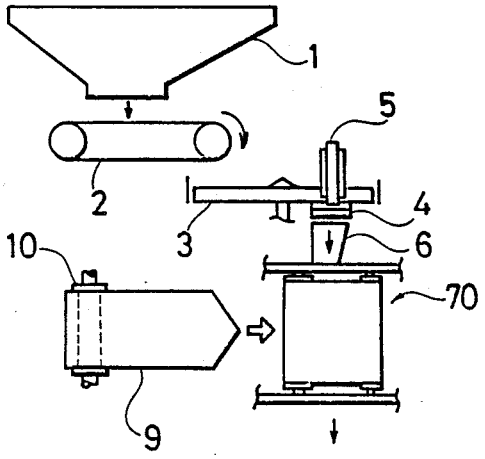
FIG. 12 is a diagrammatic view showing an internal mechanism of a second coin wrapping apparatus of the present invention.

Next, a second embodiment of the present invention will be described with reference to FIGS. 12 through 22. In these figures, the parts identical with those of the first embodiment are indicated at the same reference numerals. A coin wrapping apparatus of the second embodiment has a coin piling and wrapping unit 70 which serves both as a coin piling unit and as a coin wrapping unit. Referring to FIG. 12 showing an entire internal mechanism of the coin wrapping apparatus, a coin supply unit including a hopper 1, a belt conveyor 2, a rotary disc 3, a coin passage 4, and a delivery belt 5 is the same as the first embodiment. A specified number of coins are supplied from the coin supply unit through a chute 6 to the coin piling and wrapping unit 70. Wrapping 9 is supplied from a wrapping roller 10 of a wrapping supply unit located on a side of the coin piling and wrapping unit 70 to the coin piling and wrapping unit 70 through a wrapping feed mechanism and a cutter.

Figure 13:
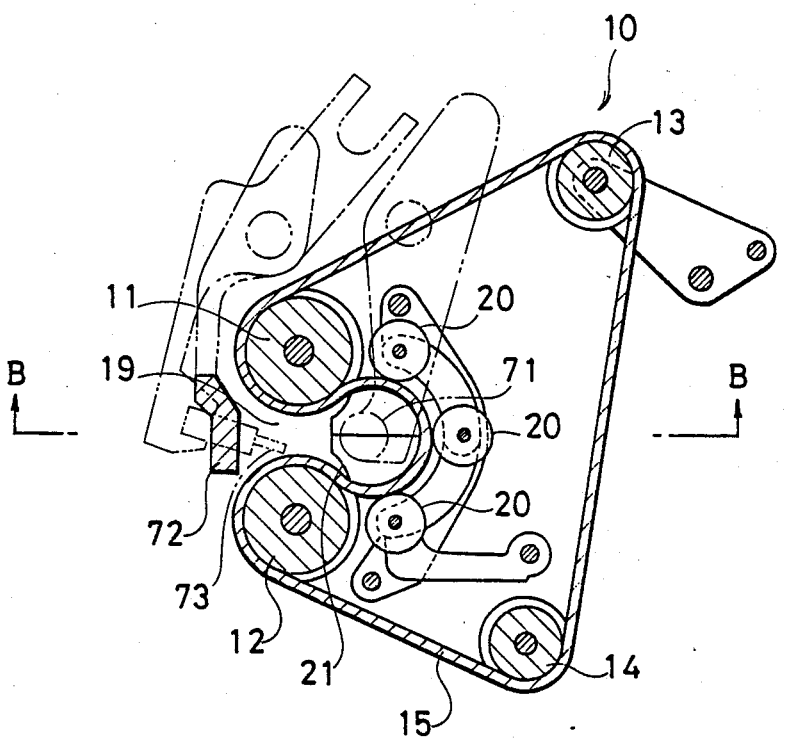
FIG. 13 is a horizontal sectional view of a coin wrapping device of the second coin wrapping apparatus.
Figure 14:
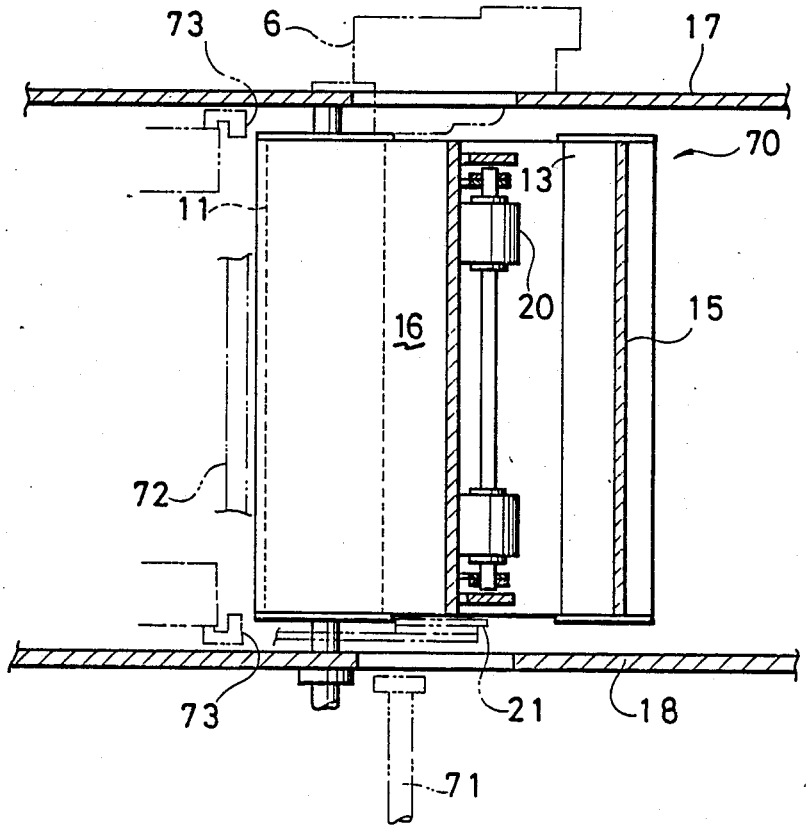
FIG. 14 is a sectional view taken along line B—B of FIG. 13.

The coin piling and wrapping unit 70, as shown in FIGS. 13 and 14, has the same principal structure as the coin piling unit 7 of the first embodiment. Specifically, the coin piling and wrapping unit 70 comprises a pair of main rollers 11 and 12, two guide rollers 13 and 14, a belt 15 passed over these rollers and being bent inward at a portion between the main rollers 11 and 12 to form a curved shape, and three backup rollers 20 provided on the back of a coin holding means 16 formed by the curved portion of the belt 15. These parts are the same in arrangement and form as the first embodiment.

The coin holding means 16 has a top opening, a bottom opening, and a side opening 19 between the main rollers 11 and 12. In this embodiment, the side opening 19 serves as an opening for introducing wrapping. The top opening and the side opening 19 are so arranged that the former corresponds to the bottom opening of the chute 6 and the latter is ahead of a moving direction of wrapping 8 fed from a wrapping supply unit. In a portion corresponding to the bottom opening of the coin holding means 16 is provided a openable shutter 21, as the first embodiment.

Furthermore, near the coin holding means 16 is provided a coin supporting device including a support rod 71 and a mechanism for operating the rod 71, a center guide 72 for preventing coins from escaping from the side opening and guiding wrapping into the coin holding means 16, and upper and lower crimping hooks 73 for crimping top and bottom ends of wrapping 8 when wrapping a pile of coins.

Figure 15:
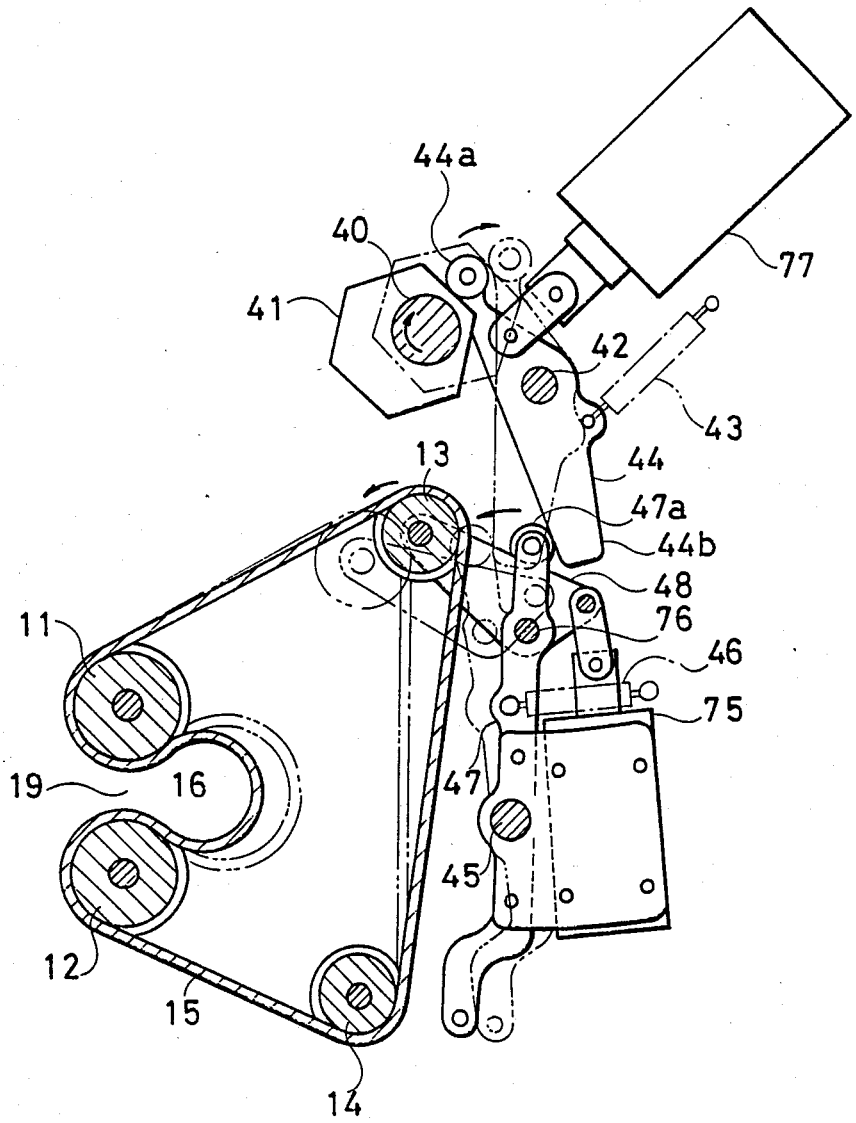
FIG. 15 is a horizontal sectional view of the coin wrapping device showing a mechanism for adjusting the position of a guide roller.

Respective positions of the guide roller 13 and the backup rollers 20 can be adjusted by position adjusting mechanisms by coin type setting operation. A position adjusting mechanism for the backup rollers 20 (not illustrated) has the same construction as the first embodiment (see FIGS. 7 and 8). A position adjusting mechanism for the guide rollers 20, as illustrated in FIG. 15, has a solenoid 75 in addition to the construction of the position adjusting mechanism of the first embodiment. The solenoid 75 is mounted on a movable block 47 to contract the coin holding means 16 so as to bring the belt 15 into contact with the coins when wrapping. A guide roller supporting bracket 48 is rotatably mounted on the movable block 47 by a shaft 76 and also connected to the solenoid 75. Accordingly, the guide roller 13 is allowed to move as the movable block 47 pivots according to the coin type setting operation. Also, the guide roller 13 is allowed to move in such a direction as to contract the coin holding means 16 when the solenoid 75 is operated. Indicated at 77 is a solenoid connected to a lever 44 for removing coins improperly piled in the coin holding means 16. The solenoid 77 is operated when turning on a reject switch, so that the guide roller 13 is moved in such a direction as to expand the coin holding means 16.

Figure 16:
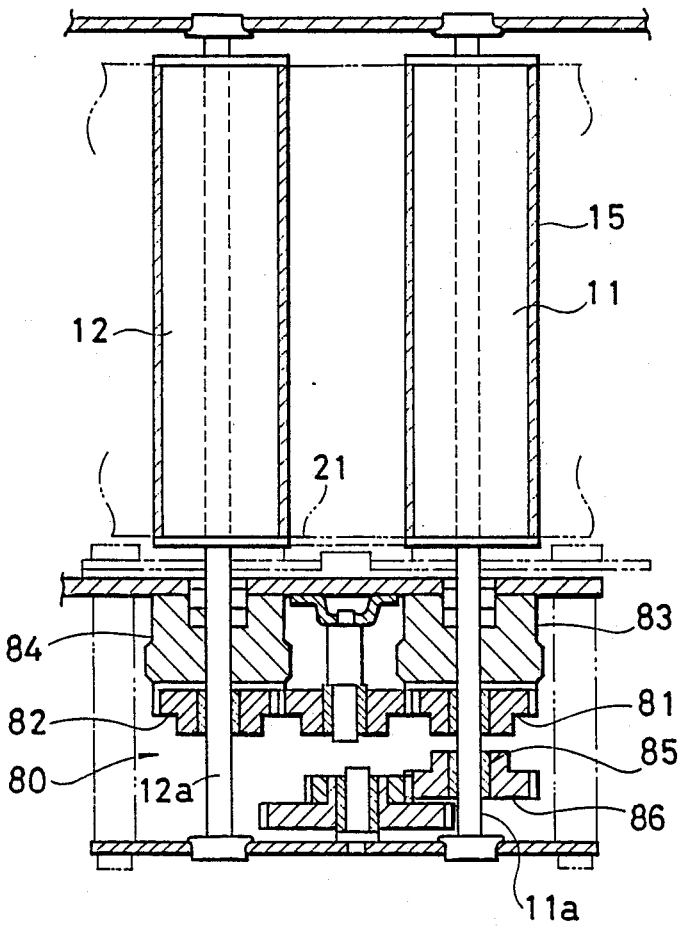
FIG. 16 is a vertical view of the coin wrapping device showing a device for driving a belt.
Figure 17:
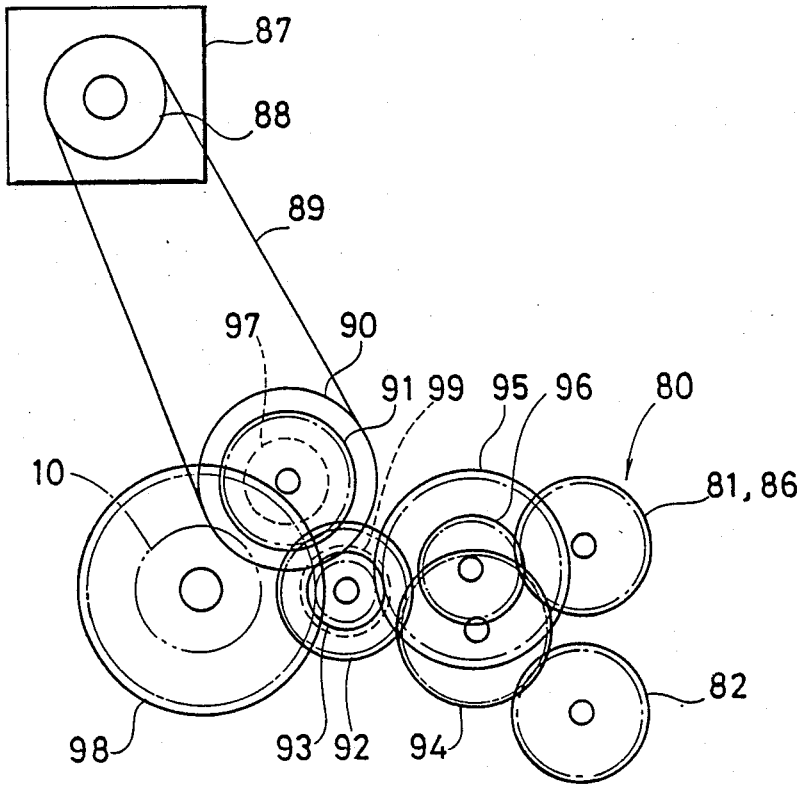
FIG. 17 is a schematic plan view of the driving device.

A driving device 80 for rotating the main rollers 11 and 12 so as to drive the belt 15 when piling and wrapping is shown in FIGS. 16 and 17. Rotating shafts 11*a* and 12*a* of the first main roller 11 which is a main roller positioned ahead in the moving direction of the belt relative to the coin holding means 16 and the second main roller 12 which is a main roller positioned behind in the moving direction of the belt relative to the coin holding means 16 are respectively attached with high speed gears 81 and 82. Also, the rotating shafts 11*a* and 12*a* are attached with first and second clutches 83 and 84 for engaging the gears 81 and 82 with the rotating shafts 11*a* and 12*a* respectively. Furthermore, the rotating shaft 11*a* of the first main roller 11 is attached with a low speed gear 86 and an one way clutch 85. Between a main motor 87 serving as a driving source and the gears 81, 82 and 86 is provided transmission device including a pulley 88, a belt 89, a pulley 90 and other transmission gears.

The transmission device includes a mechanism for transmitting rotation of the motor 87 to the high speed gears 81 and 82 in such a gear ratio through transmission gears 91, 92, 94 as to rotate the high speed gears at a high speed, for example, at 1200 r.p.m and a mechanism for transmitting rotation of the motor 87 to the low speed gear 86 in such a gear ratio through transmission gears 93, 95 and 96 as to rotate the low speed gear 86 at a low speed, for example, at 300 r.p.m. Also, the transmission device is provided with a third clutch 97 for turning on and off transmission of driving force. When the third clutch 97 is disengaged, the driving of the gears 81, 82 and 86 of the main rollers 11 and 12 is suspended. When the the third clutch 97 is engaged, the gears 81, 82 and 86 are driven. In this state, when the first and second clutches 83 and 84 are engaged, rotation of the high speed gears 81 and 82 is transmitted to the main rollers 11 and 12. When the clutches 83 and 84 are disengaged, rotation of the low speed gear 86 is transmitted to the first main roller 11 through the one way clutch 85. Furthermore, the transmission device of FIG. 17 is provided with a gear 98 for transmitting rotation of the main motor 87 through the transmission gear 93 to the wrapping roller 10 at a gear ratio to drive the wrapping roller 10 at a predetermined time, and a fourth clutch 99 for turning on and off transmission of driving force.

Figure 18:
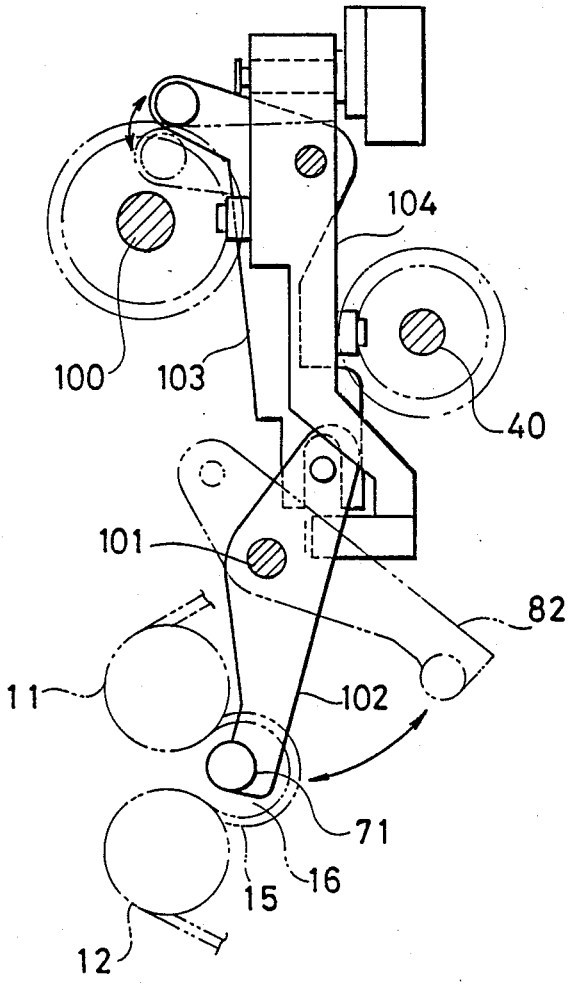
FIG. 18 is a view showing operation of a support rod provided in the coin wrapping device.
Figure 20:
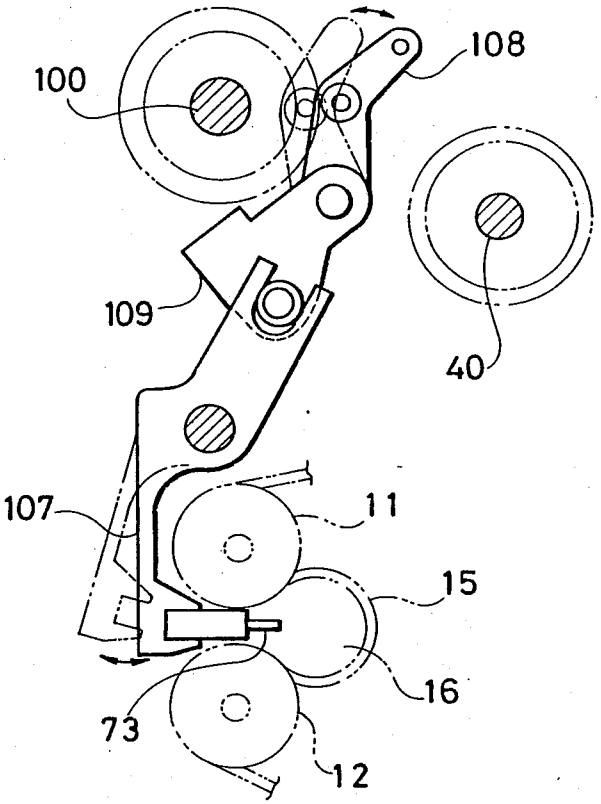
FIG. 20 is a view showing operation of a crimping hook provided in the coin wrapping device.
Figure 19:
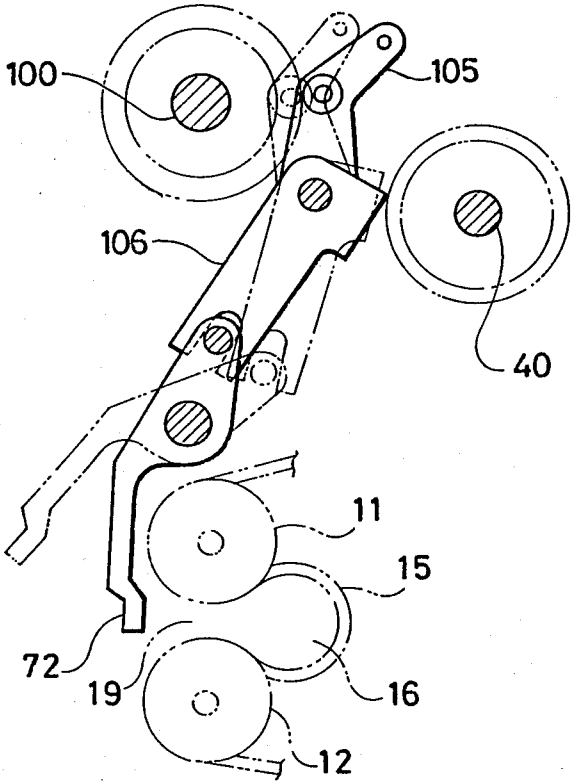
FIG. 19 is a view showing operation of a center guide provided in the coin wrapping device.
Figure 21:
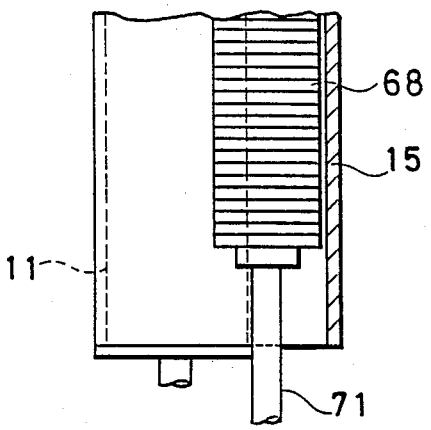
FIGS. 21 and 22 are views explaining operation of the coin wrapping device.

The supporting rod 71, center guide 72 and crimping hooks 73 are operated by a main shaft 100 and their respective actuating devices. The main shaft is driven by a motor and reduction device. The actuating devices are shown in FIGS. 18, 19 and 20 respectively.

More specifically, the supporting rod 71 is mounted on a forward end of a movable arm 102 which is rotatable about a shaft 101 and elevatable along the shaft 101. The supporting rod 71 is usually held at a position apart from the bottom opening of the coin holding means 16 as indicated by the two-dot chain lines. When coin piling operation moves to coin wrapping operation, the supporting rod 71 is moved to a position near to the bottom opening of the coin holding means 16 and then inserted in the coin holding means 16 after the shutter 21 is opened by cams for moving the supporting rod in a horizontal direction and cams for moving the supporting rod in a vertical direction, the cams being not shown in the drawing, and the arms 103 and 104. The horizontal position at which the supporting rod 71 is stayed when moving to the near position to the coin holding means 16 and the position at which it is stayed when inserted in the coin holding means 16 are adjusted by a cam provided on an actuating rod 40 according to rotation of the actuating rod 40 by the coin type setting operation. Accordingly, the horizontal and vertical positions at which a pile of coins is supported when wrapping are adjusted according to the types of coin which have different diameters and thicknesses.

The center guide 72 is stayed at the position near to side opening for introducing wrapping 19 into the coin holding means 16 when piling. When crimping, the center guide 72 is moved to a position for allowing a crimping hook lever 107 to freely move by a center guide cam (not illustrated) provided on the main shaft 100 and arms 105 and 106. The crimping hooks 73 mounted on the crimping hook lever 107 are stayed at a retracted position at a usual time. When crimping, the crimping hooks 73 are horizontally moved to positions near to the top and bottom openings of the coin holding means and then to crimping positions by cams for moving the crimping hooks horizontally and vertically (not illustrated) provided on the main shaft 100 and arms 108 and 109.

The operation of the above-described second embodiment of the present invention will be described. When a specified number of coins are fed from the coin supply unit to the coin holding means 16, coins are piled in properly prostrated state by virtue of the fact that the main rollers 11 and 12 are driven with the guide roller 13 and the backup rollers 20 being adjusted to appropriate positions by the coin type setting operation as the first embodiment.

When this coin piling operation is completed, the driving of the main rollers 11 and 12 is temporarily stopped. Thereafter, for the wrapping operation, the supporting rod 71 is moved to the near position to the bottom opening of the coin holding means 16. After the shutter 21 is opened, the supporting rod 71 is raised to support a pile 68 of coins and more raised to move the pile 68 to a predetermined position (see FIG. 21).

Figure 22:
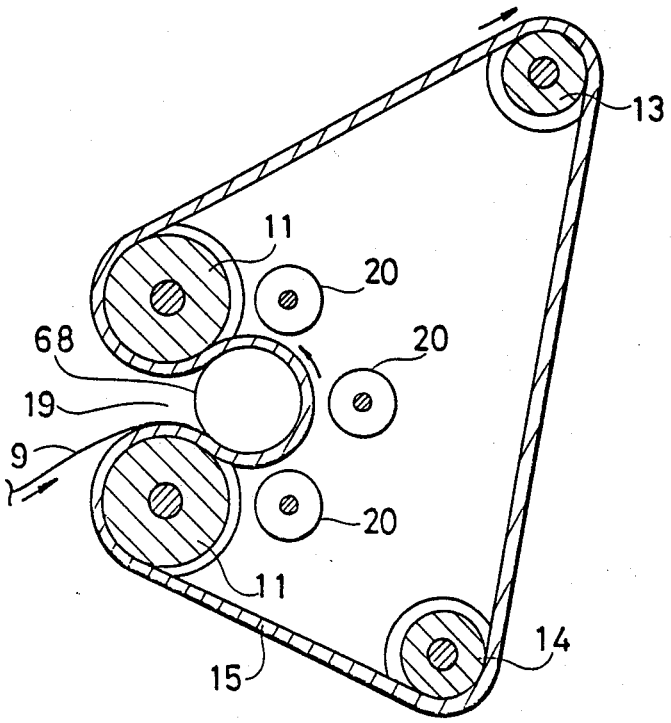
Figure 23:
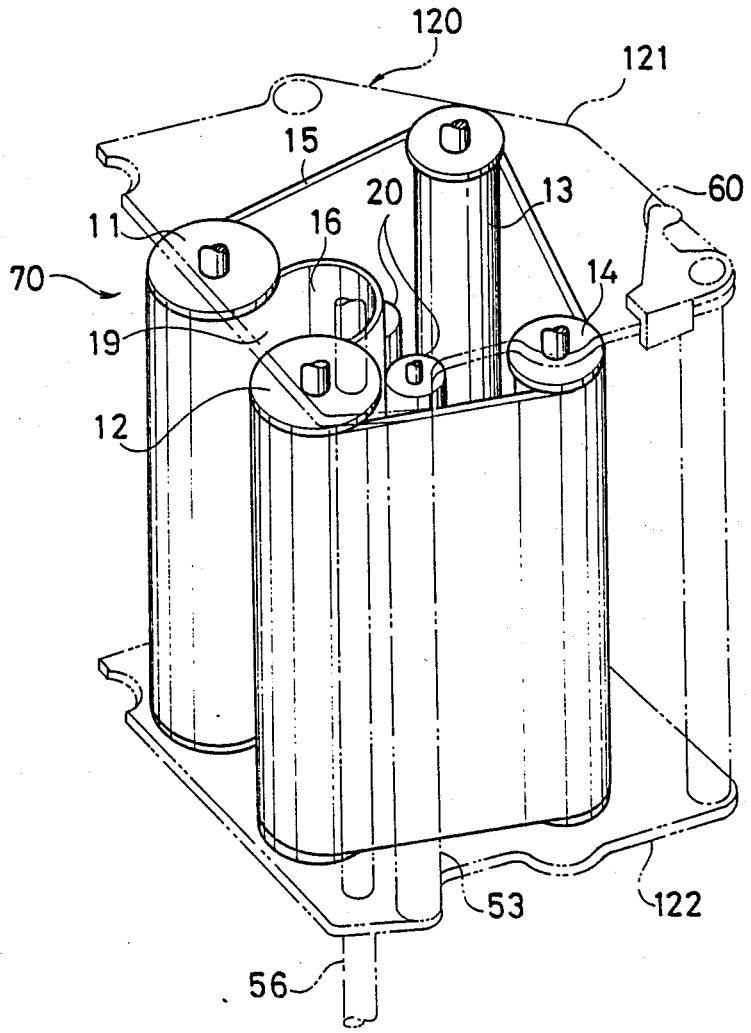
FIG. 23 is a perspective view of a mounting portion of a coin wrapping device of a third coin wrapping apparatus of the present invention.

With wrapping operation, as shown in FIG. 22, wrapping 9 supplied from the wrapping supply unit is introduced into the coin holding means 16 through the side opening 19. Simultaneously, the solenoid 75 for driving the guide roller 13 is operated to contract the coin holding means 16. Consequently, the portion of the belt 15 where the coin holding means 16 is formed comes into contact with the pile 68 of coins with the wrapping 9 being placed between them. The wrapping 9 is fed with being placed between them. The first main roller 11 is rotated at a relatively low speed. The rotation of the main roller 11 moves the belt 15 circumferentially and simultaneously rotates the pile 68 of coins. Also, the second main roller 12 is rotated following the rotation of the main roller 11. Consequently, the wrapping 9 is wrapped around the pile 68 of coins. After a wrapping a specified length is wrapped around the pile 68 of coins, the upper and lower crimping hooks 73 are moved to the predetermined determined position and the main rollers 11 and 12 are then driven at a high speed so that the upper and lower ends of the wrapping protruding from the top and bottom of the pile 68 of coins are crimped. When the wrapping operation is completed, the supporting rod 71 is retracted and the wrapped pile of coins are discharged.

As this way, coin piling and coin wrapping are performed in a single coin holding means 16 formed by the belt 15.

It should be noted that in the coin piling unit 7 of the first embodiment and the coin piling and wrapping unit of the second embodiment, guide rollers and backup rollers may be desirably increased or decreased. Also, it should be noted that mechanisms for adjusting the positions of these rollers, a driving device for rotating main rollers so as to drive a belt, a mechanism for actuating supporting rod, and a mechanism for actuating crimping hooks are not limited to the above-mentioned embodiments and may be desirably changed unless such changes depart from the scope of the present invention.

A third embodiment of the present invention will be described with reference to FIGS. 23 through 27. In the third embodiment, the main parts of a coin piling and wrapping unit is supported on a supporting frame 120 which can be placed in and out of a main body of a coin wrapping apparatus 110.

In the third embodiment, a coin piling and wrapping unit 70, as the second embodiment, comprises a pair of main rollers 11 and 12, two guide rollers 13 and 14, a belt 15 passed over these rollers, three backup rollers 20 provided on the back of a coin holding means 16 formed by a curved portion of the belt 15, a shutter 21, a supporting rod, a center guide and crimping hooks. However, the supporting rod, center guide and crimping hooks are not illustrated. Rotating shafts 11*a*, 12*a* of the main rollers 11 and 12 are rotatably mounted on upper and lower supporting plates 121 and 122 of a supporting frame 120. The portions of the rotating shafts 11*a* and 12*a* which protrude below the lower supporting plate 122 are attached with high speed gears 81 and 82, clutches 83 and 84, a one way clutch 85 and a low speed gear 86. These gears constitute a device for driving the belt 15. As described in the second embodiment, rotation of a motor is transmitted to the high speed gears 81 and 82, and the low speed gear 86 at a proper gear ratio through a transmission device (see FIG. 26). The guide roller 13 is movably mounted on the supporting plates 121 and 122 by a movable block 47 and a bracket 48. The guide roller 14 is fixedly mounted on the supporting plates 121 and 122.

Mechanisms for adjusting the positions of the guide roller 13 and the backup rollers 20 are also constructed in the same manner as the second embodiment. A fulcrum shaft 45 of a movable block 47 is mounted on the support plates 121 and 122. The backup rollers are movably mounted on the support plates 121 and 122 by the position adjusting mechanism.

Figure 24:
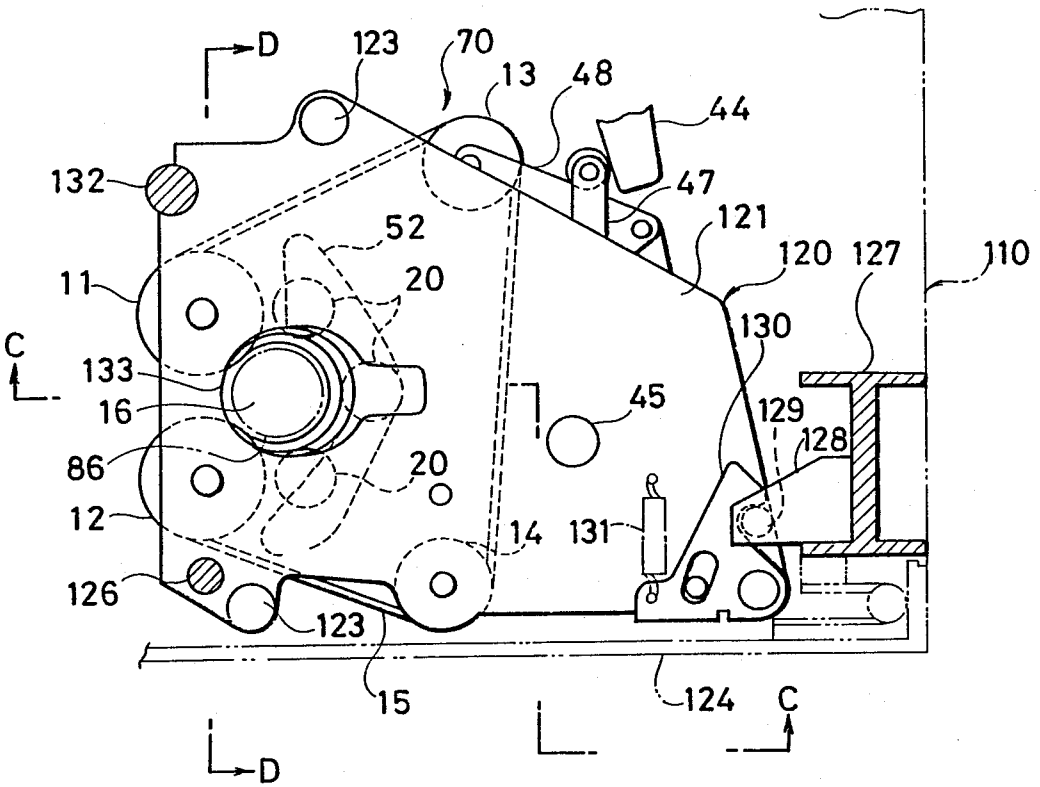
FIG. 24 is a plan view of the mounting portion.
Figure 25:
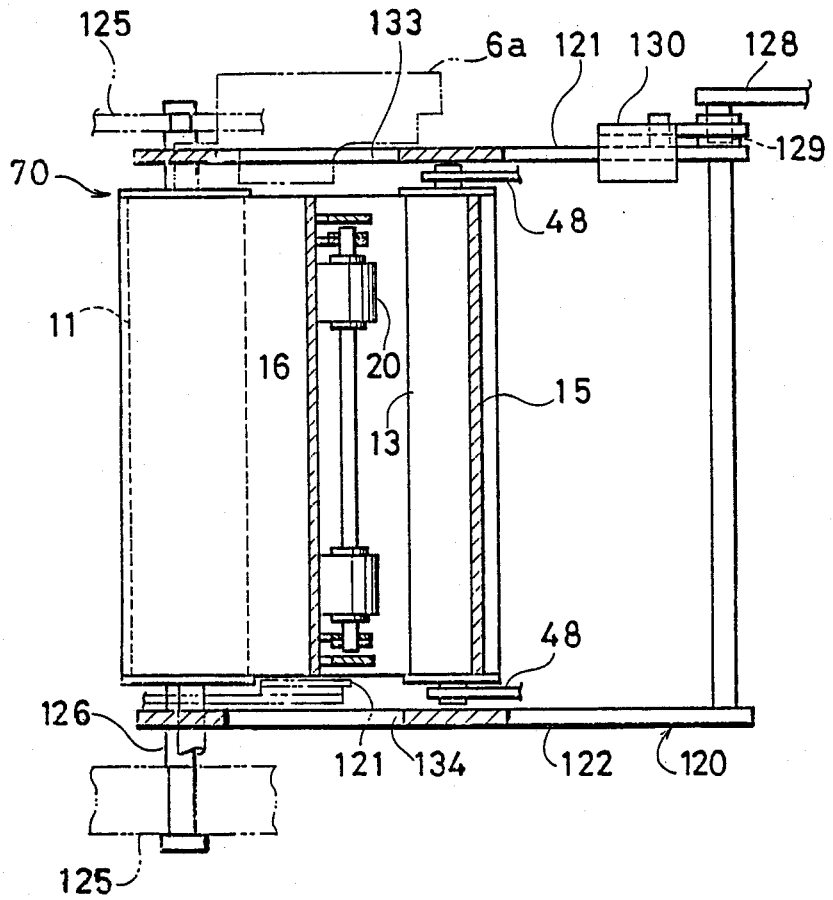
FIG. 25 is a sectional view taken along line C—C of FIG. 24.
Figure 26:
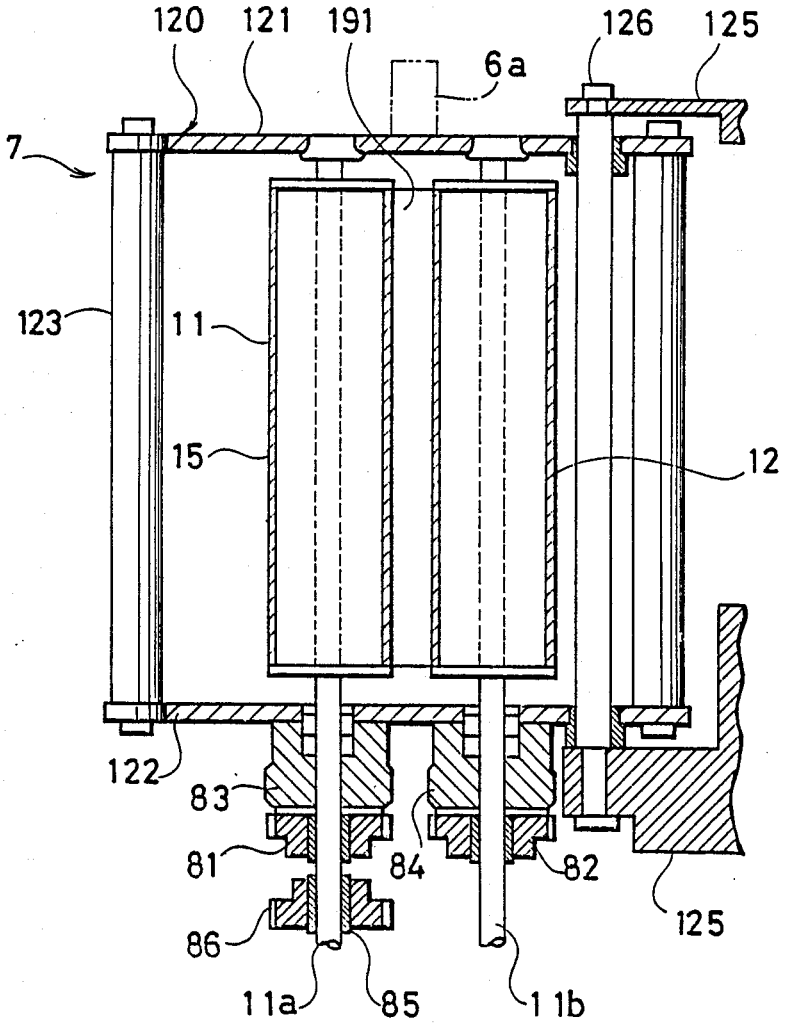
FIG. 26 is a sectional view taken along line D—D of FIG. 24.
Figure 27:
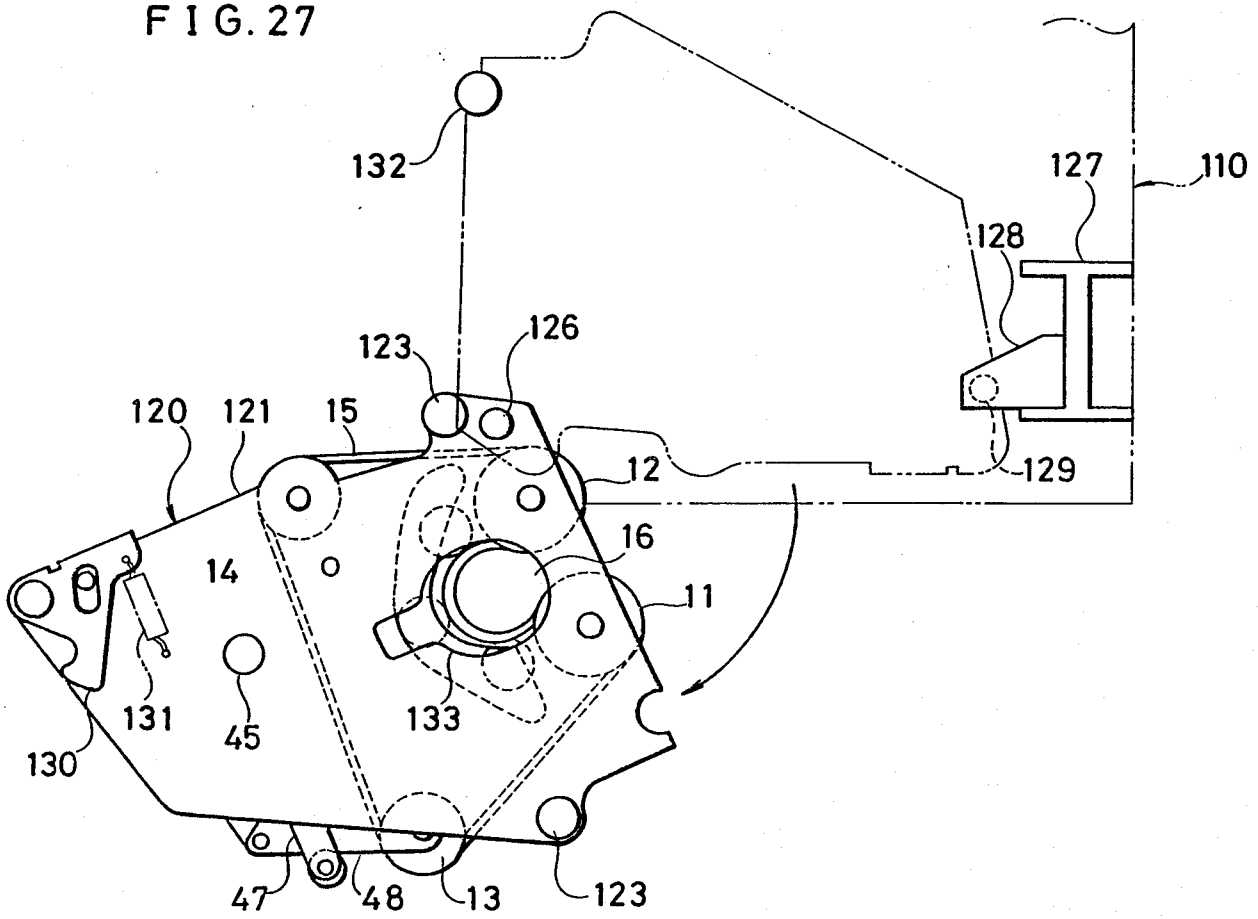
FIG. 27 is a plan view of the mounting portion showing an opened state thereof.

The support frame 120 is constructed by connecting the upper and lower support plates 121 and 122 by a plurality of rods 123. The support frame 120 is pivotably mounted to the main body of the coin wrapping apparatus 110. Specifically, the forward side end of the support frame 120 which is near a door 124 of the main body of the coin wrapping apparatus 120 is axially supported on a fixed frame 125 of the main body of the coin wrapping apparatus 110 by a longitudinal rod 126. Consequently, the support frame 120 can be moved in such a manner as to bring the frame 120 into an inserted state that the coin piling and wrapping unit is entirely positioned in the main body of the coin wrapping apparatus 110 as illustrated in FIG. 24, or into a withdrawn state that the support frame 120 is mostly positioned outside the main body of the coin wrapping apparatus 110 as illustrated in FIG. 27.

Between the other forward side end of the support frame 120 and the main body of the wrapping apparatus 110 is provided a releasable stopper for maintaining the inserted state. The stopper includes an engaging projection 129 provided on a member 128 laterally protruded from a fixed frame 127 of the main body of the wrapping apparatus 110 and a hook-shaped engaging piece 130 rotatably mounted on the support frame 120. When the coin piling and wrapping unit is in the inserted state, the engaging piece 130 is biased by a spring 131 so as to engage the engaging projection 129. Indicated at 132 is a rod-shaped stopper provided in the main body of the coin wrapping apparatus 110. When the coin piling and wrapping unit is in the inserted state, a rear side end of the support frame 120 is made in contact with the stopper 132.

In portions of the upper and lower support plates 121 and 122 which correspond to the coin holding means 16 are provided holes 133 and 134 for allowing coins to pass. In addition, to the upper support plate 121 is attached a lower half portion 6*a* of a coin guide chute 6. A shutter 21 is mounted on the lower support plate 122. The supporting rod, center guide and crimping hooks, not being illustrated, are movably provided at specified positions in the main body of the wrapping apparatus 110 through their respective actuating mechanisms.

The operation of the above-described third embodiment will be described. The coin piling and wrapping unit 70, as illustrated in FIG. 24, is kept in the inserted state that it is entirely positioned inside the main body of the coin wrapping apparatus 110 at a usual time. In this state, coin wrapping operation is carried out as described in the second embodiment.

During the coin wrapping operation, if jam occurs in the coin piling and wrapping unit, the support frame 120 and the main parts of the coin wrapping unit mounted on the support frame 120 are brought into the withdrawn state as illustrated in FIG. 27. Consequently, jammed wrapping is removed with ease. More specifically, when jam occurs, the door 124 of the main body of the coin wrapping apparatus is opened and then the engaging piece 130 is disengaged from the engaging projection 129. Thereafter, the support frame 120 is rotated forward about the longitudinal rod 126, so that the support frame 120, the main rollers 11 and 12, the guide rollers 13 and 14, the backup rollers 20, a part of the driving device, and a part of the position adjusting mechanisms are moved forwardly. Accordingly, jammed wrapping is easily removed from the top or bottom portion of the coin holding means 16, or the side opening 19. After jammed wrapping is removed, the support frame 120 is easily returned to the inserted state by pushing it to the inside of the main body of the coin wrapping apparatus. Also, the supporting frame 120 is assuredly set at the proper position by the stopper 132.

What we claim is:

1. A coin stacking apparatus for stacking coins in a vertical stack, comprising a support means, a pair of main rollers mounted on said support means for rotation about vertical axes, said main rollers being spaced from one another, guide roller means mounted on said support means spaced from said main rollers, said guide roller means comprising a guide roller having an axis which is vertically disposed, an endless belt disposed about said main rollers and said guide roller means, said endless belt passing over said main rollers and extending past said main rollers to form a substantially cylindrical loop section which opens up into the space between said pair of main rollers, said loop section having an inner side and an outer side, said inner side receiving said coins to be stacked, backup roller means disposed on said support means about the outside of said loop section for supporting the outside of said loop section while said coins are being stacked in said loop section, and a drive means for driving said endless belt about said main rollers and said guide roller means as said coins are fed downwardly into said loop section to be stacked in the inner side of said loop section as said backup roller means support the outside of said loop section.

2. A coin stacking apparatus according to claim 1, wherein said loop section has an inner diameter corresponding substantially to the diameter of the coins to be stacked, and further comprising adjusting means for adjusting said diameter to thereby provide for stacking coins of different diameters.

3. A coin stacking apparatus according to claim 2, wherein said adjusting means comprises linkage means for varying the spacing between said guide roller and said main rollers to thereby adjust the diameter of said loop section so that said loop section can stack different diameter coins.

4. A coin stacking apparatus according to claim 1, further comprising adjusting means for adjusting the position of said backup roller means relative to said main rollers to thereby support loop sections of different diameters.

5. A coin stacking apparatus according to claim 1, further comprising adjusting means for adjusting the position of said guide roller relative to said main rollers and for adjusting the position of said backup roller means relative to said main rollers to thereby adjust the diameter of said loop section to stack different diameter coins.

6. A coin stacking apparatus according to claim 5, wherein said adjusting means comprises a control element which is movably adjustable to simultaneously adjust the position of said guide roller and said backup roller means.

7. A coin stacking apparatus according to claim 1, wherein said backup roller means comprises a plurality of backup rollers disposed in a partial circular array corresponding to the circular configuration of said loop section such that said backup rollers support said loop section substantially in the form of a cylinder.

8. A coin stacking apparatus according to claim 7, wherein said backup roller means comprises block support means for supporting said backup rollers, and pivotal support means for pivoting said block support means to different positions depending on the diameter of the coins to be stacked.

9. A coin stacking apparatus according to claim 1, wherein said loop section has an upper end and a lower end, further comprising shutter means at said lower end movable between an underlying position underlying said loop section and a position spaced from said underlying position.

10. A coin stacking apparatus according to claim 1, further comprising a guide means juxtaposed to said space between said main rollers for preventing coins from escaping through said space between said main rollers.

11. A coin stacking apparatus according to claim 1, wherein said drive means comprises drive elements for driving said main rollers and clutch means between said drive elements and each of said main rollers such that said main rollers can be separately driven and synchronously driven.

12. A coin stacking apparatus according to claim 1, wherein the space between said main rollers is less than the diameter of the coins being stacked.

13. A coin stacking apparatus according to claim 1, wherein said guide roller is designated a first guide roller, said guide roller means further comprising a second guide roller spaced from said first guide roller and having an axis which is vertically disposed, said second guide roller and said main rollers being mounted in fixed positions on said support means, said guide roller means comprising adjusting means for adjusting the position of said first guide roller relative to said main rollers and relative to said second guide roller to thereby adjust the diameter of said loop section to stack different diameter coins.

14. A coin stacking and wrapping apparatus for stacking coins in a vertical stack and for wrapping said vertical stack with a wrapping material comprising a support means, a pair of main rollers mounted on said support means for rotation about vertical axes, said main rollers being spaced from one another, guide roller means mounted on said support means spaced from said main rollers, said guide roller means comprising a guide roller having an axis which is vertically disposed, an endless belt disposed about said main rollers and said guide roller means, said endless belt passing over said main rollers and extending past said main rollers to form a substantially cylindrical loop section which opens up into the space between said pair of main rollers, said loop section having an inner side and an outer side, said inner side receiving said coins to be stacked, wrapping means operable to feed wrapping material into said space between said two mains rollers, and drive means for driving said endless belt about said main rollers and said guide roller means as said coins are fed downwardly into said loop section to thereby stack said coins in said loop section and subsequently wrap said stacked coins in said loop section with said wrapping material.

15. A coin stacking and wrapping apparatus according to claim 14, wherein said wrapping means comprises positioning means for positioning said stack in said loop section after the stacking has been completed, such positioning being effected prior to wrapping of said coins with said wrapping material.

16. A coin stacking and wrapping apparatus according to claim 15, wherein said positioning means is operable to raise said stacked coins to a predetermined position in said loop position.

17. A coin stacking and wrapping apparatus according to claim 16, wherein said positioning means comprises a support rod having an operating position underlying said stack in said loop section and vertically movable to raise said stack to said predetermined position.

18. A coin stacking and wrapping apparatus according to claim 17, wherein said positioning means comprises operable means operable to move said support rod between said operable position underlying said stack and another position horizontally spaced from said operable position.

19. A coin stacking and wrapping apparatus according to claim 14, wherein said loop section has a top end and a bottom end and said stack has a top and a bottom, said wrapping means further comprising crimping means juxtaposed to said top and bottom ends of said loop section for crimping said wrapping material at the top and bottom of said stack after said wrapping material has been wrapped around said stack.

20. A coin stacking and wrapping apparatus according to claim 19, wherein said crimping means comprises operable means for moving said crimping means to an operable position underlying and overlying said stack and to another position spaced from said operable position.

21. A coin stacking and wrapping apparatus according to claim 14, further comprising a guide means having an operable position juxtaposed to said space between said main rollers for preventing coins from escaping through said space while said coins are being stacked, and operable means operable to move said guide means between said operable position and another position spaced from said operable position.

22. A coin stacking and wrapping apparatus according to claim 14, further comprising backup roller means disposed on said support means about the outside of said loop section for supporting the outside of said loop section.

23. A coin stacking and wrapping apparatus according to claim 22, wherein said loop section has an inner diameter corresponding substantially to the diameter of the coins to be stacked, and further comprising adjusting means for adjusting said diameter to thereby provide for stacking coins of different diameters.

24. A coin stacking and wrapping apparatus according to claim 23, wherein said adjusting means comprises actuating means operable to move said guide roller relative to said main rollers after stacking has been completed to cause wrapping material which has been fed between said stack and said loop section to be engaged between said stack and said loop section and wrapped around said stack as said belt moves over said main rollers and said guide roller means.

25. A coin stacking and wrapping apparatus according to claim 23, wherein said wrapping means is operable to feed wrapping material to said space between said main rollers, said adjusting means comprising actuating means which is operable to move said guide roller relative to said main rollers after said stacking has been completed such that said wrapping material which has been bed to said space between said main rollers is engaged between said loop section and said stack and wrapped around said stack as said belt moves over said main rollers and said guide roller means.

26. A coin stacking and wrapping apparatus according to claim 25, wherein said adjusting means comprises a mechanical linkage means mechanically connected to said guide roller and said backup roller means and a movable control element which is movable to different positions for controlling said mechanical linkage means such that said mechanical linkage means simultaneously adjusts the position of said guide roller and said backup roller means, said adjusting means comprising a solenoid means operably connected to said mechanical linkage means and operable to actuate said mechanical linkage means to move said guide roller relative to said main rollers without movement of said control element.

27. A coin stacking and wrapping apparatus according to claim 14, wherein said drive means comprises a gearing means, and clutch means operable to connect and disconnect said gearing means to thereby provide for driving one or both of said main rollers and to provide for driving said main rollers at different speeds.

28. A coin stacking and wrapping apparatus according to claim 14, wherein said support means comprises a main frame and a support structure; pivotable means pivotably mounting said support structure on said main frame; said main rollers, said guide roller means, and said backup roller means being mounted on said support structure; said support structure being pivotably between an operable position wherein said support structure is disposed substantially within said main frame and another position in which said support structure is disposed substantially outside of said main frame to facilitate servicing; and latch means for latching said support structure in said operating position.

29. A coin stacking and wrapping apparatus according to claim 28, wherein said support structure comprises spaced upper and lower support plates, and support rods connecting said support plates.

* * * * *